United States Patent [19]

Kikuchi et al.

[11] 4,261,141

[45] Apr. 14, 1981

[54] FEED AMOUNT SETTING DEVICE FOR A MACHINE TOOL

[75] Inventors: Makoto Kikuchi; Yasuo Suzuki; Yukio Oda, all of Kariya, Japan

[73] Assignee: Toyoda Koki Kabushiki Kaisha, Kariya, Japan

[21] Appl. No.: 114,401

[22] Filed: Jan. 22, 1980 (Under 37 CFR 1.47)

[30] Foreign Application Priority Data

Jan. 23, 1979 [JP] Japan ..... 54/7540[U]

[51] Int. Cl.[3] ..... B24B 49/00

[52] U.S. Cl. ..... 51/165.8

[58] Field of Search ..... 51/165 R, 165.8, 165.81, 51/165.85

[56] References Cited

U.S. PATENT DOCUMENTS

| | | | |
|---|---|---|---|
| 3,593,463 | 7/1971 | Uhtenwoldt | 51/165.8 |
| 3,665,653 | 5/1972 | Kobayashi | 51/165.81 |
| 3,822,512 | 7/1974 | Mercer | 51/165.81 |
| 4,086,729 | 5/1978 | Kikuchi | 51/165.8 |

*Primary Examiner*—Harold D. Whitehead

*Attorney, Agent, or Firm*—Oblon, Fisher, Spivak, McClelland & Maier

[57] ABSTRACT

A feed amount setting device for a machine tool is provided wherein a cradle member, urged for contact engagement with a plate cam, is pivoted within a plane including the rotational axis of the plate cam when the same is rotated by a tool slide feed device. The pivotal movement of the cradle member is converted into the axial movement of a slide sleeve and an actuation sleeve, which is threadedly inserted into the slide sleeve for adjustment of the relative position thereto, in a direction parallel to the rotational axis of the plate cam. The actuation sleeve is formed at its one end with a radially extended flange contacting a lever arm and, when axially moved, pivotally moves the lever arm to thereby actuate a switch element. This element, when actuated, controls the operation of the tool slide feed device.

4 Claims, 6 Drawing Figures

FEED AMOUNT SETTING DEVICE FOR A MACHINE TOOL

BACKGROUND OF THE INVENTION

1. Field of the Invention

This invention relates generally to machine tools, and more particularly, to a device for setting the feed amount of a tool or workpiece carrier of a machine tool.

2. Description of the Prior Art

Generally, in grinding machines capable of automatic plunge grinding, it is necessary to set or adjust the grinding feed amount of a wheel head in advance of grinding a batch of workpieces. U.S. Pat. No. 4,086,729 to M. Kikuchi et al. discloses a feed amount setting device of this type, wherein a follower rod is axially slidably supported to follow a cam way formed on a circumferential surface of a rotatable plate cam and is formed at its circumferential surface with an operating face for pivoting a lever arm whose movement is transmitted to actuate a switch element. However, in the known device, the rotation of the plate cam causes the follower rod to displace not only in the axial direction but also in the radial direction due to the presence of an unavoidable play between the follower rod and a receiving bore thereof, and such radial displacement of the follower rod undesirably results in fluctuating the actuation point of the switch element. Moreover, mechanisms which are incorporated into the device respectively for transmitting the pivotal movement of the lever arm to a switch actuation element and for adjusting the relative position of the lever arm to the operating face of the follower rod are complicated in construction and causes an increase of cost.

SUMMARY OF THE INVENTION

Accordingly, it is a primary object of the present invention to provide an improved feed amount setting device wherein any desirably adjusted actuation point of a switch element is free from fluctuation.

Another object of the present invention is to provide an improved feed amount setting device of the character set forth above which is simple in construction, reliable in operation and is reduced in cost.

Briefly, according to the present invention, there is provided an improved feed amount setting device for a machine tool, which comprises a cam member having a cam way and movable by a feed device which relatively feeds tool and workpiece carriers, and a cradle member pivotable within a first plane perpendicular to a second plane within which the cam way extends and urged to contact the cam way. A slide sleeve, slidable in a direction parallel to the first plane, is formed with a contact surface extending perpendicularly to the first plane for contact engagement with the cradle member. An actuation sleeve, formed with an actuation surface extending perpendicularly to the axis thereof, is coaxially received in and threadedly engaged with the slide sleeve and is rotatable by an adjusting mechanism for adjustment of the relative position to the slide sleeve. A pivotable lever arm is further provided, which is urged to contact the actuation surface of the actuation sleeve for transmitting the axial movement of the actuation sleeve to one end thereof in a predetermined magnification ratio. A switch element is stationarily disposed in abuttable relation with the one end of the lever arm for controlling the feed device when actuated by the one end of the lever arm.

In the setting device according to the present invention, since the contact surface of the slide sleeve and the actuation surface of the actuation sleeve extend perpendicularly to the axis of the slide sleeve and the acatuation sleeve, no movement is transmitted to the lever arm even when the actuation sleeve is radially displaced due to the presence of a play between itself and a threaded internal surface of the slide sleeve and a play between the slide sleeve and a related receiving bore, so that any actuation point of the switch element, once adjusted, can be free from fluctuation. In addition, since the cradle member is carried to pivot within the first plane perpendicular to the second plane within which the cam way extends, the contact relation of the cradle member with the cam member can be maintained unchanged regardless of the pivotal position of the cradle member, and this advantageously makes it possible to precisely adjust the actuation point of the switch element.

BRIEF DESCRIPTION OF THE DRAWINGS

Various other objects, features and attendant advantages of the present invention will readily be appreciated as the same becomes better understood by reference to the following detailed description of a preferred embodiment when considered in connection with the accompanying drawings, in which.

DETAILED DESCRIPTION OF THE PREFERRED EMBODIMENT

Figure 1:
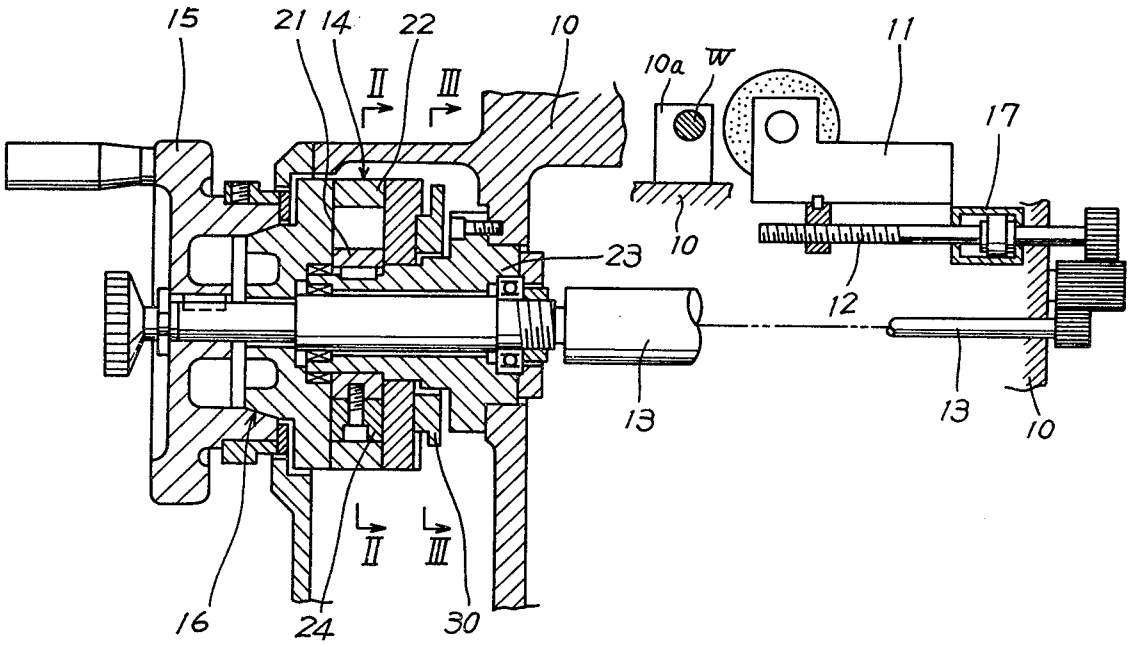
FIG. 1 is a longitudinal sectional view of a wheel head feed device incorporating a feed amount setting device according to the present invention.

Referring now to the drawings, wherein like reference numerals designate like or corresponding parts throughout the several views, and particularly to FIG. 1 thereof, the reference numeral 10 denotes a bed of a grinding machine, on which a wheel carrier or head 11 is slidably mounted to be forwardly and backwardly moved by a feed screw 12 to and from a carrier **10*a* for a workpiece W. The feed screw 12 is drivingly connected through a gear train, not numbered, with a drive shaft 13, which is in turn connected with a drive device 14 so as to be rotated thereby. A hand wheel 15 is keyed on one end of the drive shaft 13 and is connectable integrally with the drive device 14 by means of a clutch 16. The reference numeral 17** denotes a rapid feed actuator.

Figure 2:
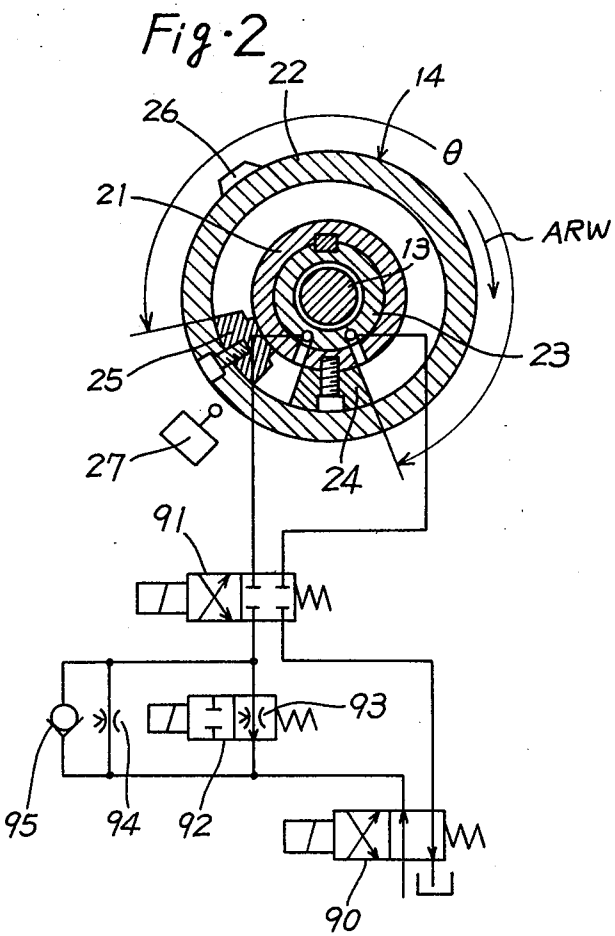
FIG. 2 is a sectional view taken along the line II—II of FIG. 1.
Figure 3:
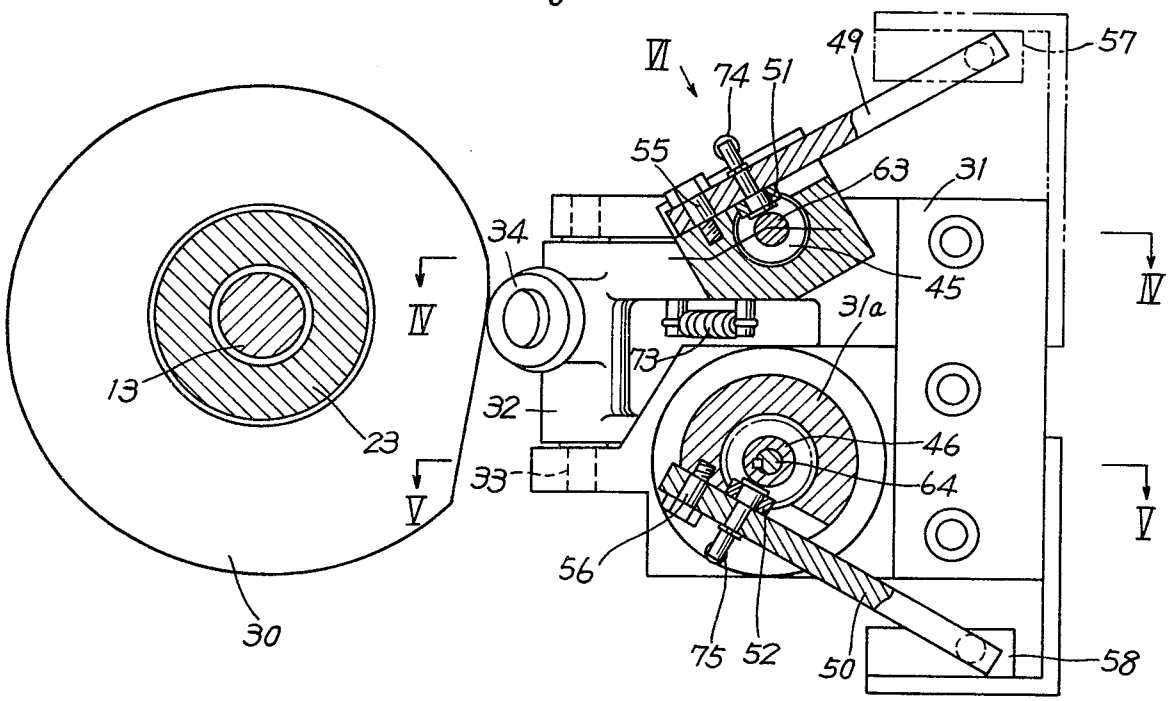
FIG. 3 is a sectional view taken along the line III—III of FIG. 1.
Figure 4:
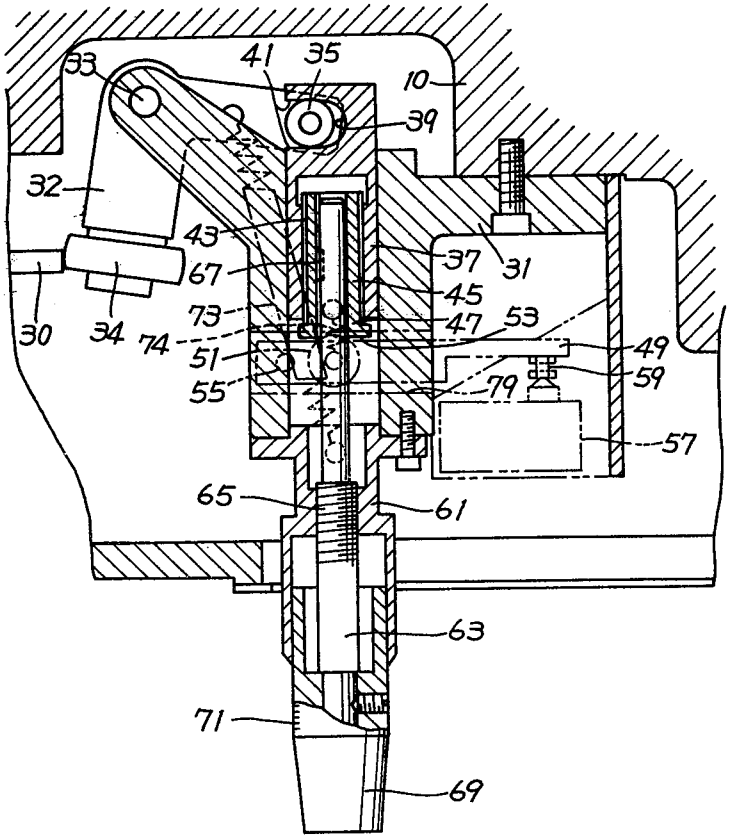
FIG. 4 is a sectional view taken along the line IV—IV of FIG. 3.
Figure 5:
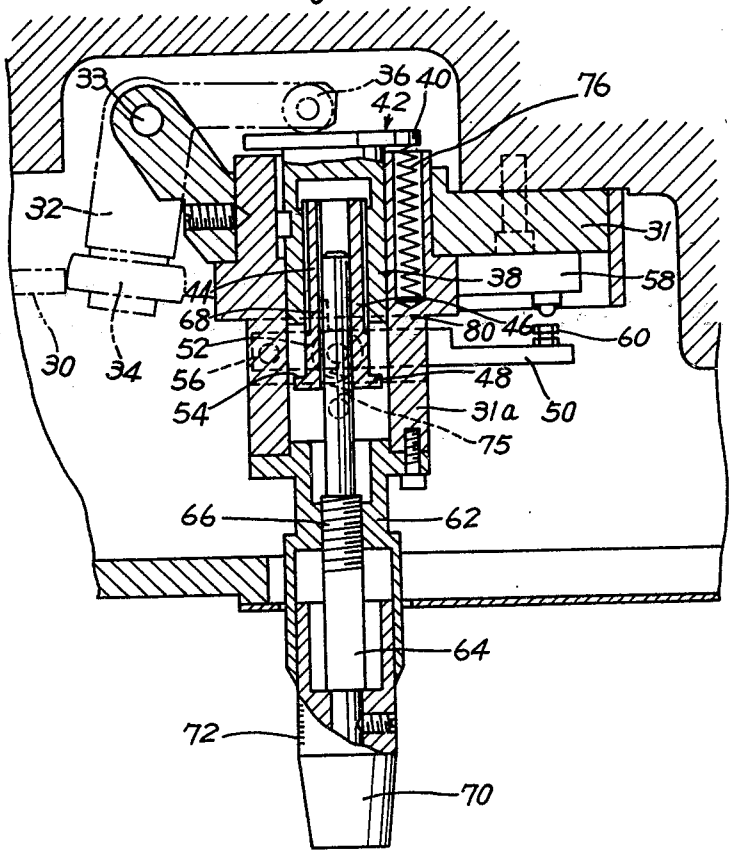
FIG. 5 is a sectional view taken along the line V—V of FIG. 3.

The drive device 14 is constructed by a rotational actuator composed of a cylinder housing 22 and an internal cylinder 21 which is contained in the housing 22 to be rotatable relative thereto. The internal cylinder 21 is keyed on a support sleeve 23 fixed on the bed 10, while the cylinder housing 22 is rotatably supported on the support sleeve 23. As best shown in FIG. 2, the internal cylinder 21 has a dead stop 24 fixed on the outer periphery thereof, and the cylinder housing 22 has fixed on its internal surface a movable wing 25, which is in an abuttable relation with the dead stop 24. Also provided on the cylinder housing 22 is a dog 26, by which a limit switch 27 is disposed to be activated for confirming the advanced feed end of the wheel head 11. Behind and to the cylinder housing 22, there is secured a plate cam 30 with a circumeferential cam way, in opposition to which a main body 31 of a feed amount setting device is fixedly mounted on the bed 10. As shown in FIGS. 3 to 5, an L-shape cradle yoke 32 is carried by the main body 31 for pivotal movement about a hinge pin 33, which extends perpendicularly to the rotational axis of the plate cam 30. The cradle yoke 32 rotatably carries at a single one end thereof a follower roller 34 engageable with the circumferential cam way of the cam plate 30 and also rotatably carries a pair of guide rollers 35 and 36 respectively at double other ends thereof.

A pair of slide sleeves 37 and 38 are slidably guided respectively within the main body 31 and a guide bush 31a, secured thereto, for slide movement in a direction parallel to the rotational axis of the plate cam 30. The slide sleeve 37 protrudes from the main body 31 one end thereof, on which an engaging groove 39 is formed for snugly receiving the guide roller 35. The slide sleeve 38 also protrudes from the guide bush 31a one end thereof, on which an engaging flange 40 is formed for abutting engagement with the guide roller 36. Engaging surfaces 41 of the groove 39 and an engaging surface 42 of the flange 40 extend perpendicularly to the sliding direction of the slide sleeves 37, 38. It is therefore realized that even when the guide sleeves 37, 38 are displaced in their radial directions because of the presence of a play between each of the guide sleeves 37, 38 and a related receiving bore, no variation is effected with the relative position between each of the guide sleeves 37, 38 and the related one of the guide rollers 35, 36 in the axial direction of the guide sleeves 37, 38. Furthermore, the guide sleeves 37, 38 are formed on their internal surfaces with female screws 43 and 44, which are engaged with male screws formed on the outer surfaces of the actuation sleeves 45 and 46, respectively. These actuation sleeves 45, 46 are provided at each one end with flanges 47 and 48, on which contact surfaces 53 and 54 are formed for contact engagement with contact rollers 51 and 52, respectively. The contact surfaces 53, 54 extend perpendicularly to the sliding direction of the slide sleeves 37 and 38, and the relative positions of the actuation sleeves 45, 46 to the contact rollers 51, 52 in the axial directions of the actuation sleeves 45, 46 can therefore be prevented from variation even when the actuation sleeves 45, 46 are displaced in their radial directions due to the presence of plays at their thread engagement portions with the slide sleeves 37 and 38, respectively.

Lever arms 49, 50 are pivotally carried by means of hinge pins 55, 56 at each one end thereof and rotatably carry the contact rollers 51, 52 at each middle portion thereof, respectively. Further, the lever arms 49, 50 have adjustably secured to each the other end thereof actuation pieces 59 and 60, which serve to actuate limit switches 57 and 58, respectively. The distances between the actuation pieces 59, 60 and the hinge pins 55, 56 are determined to be several times as long as those between the contact rollers 51, 52 and the hinge pins 55, 56, so that the displacements of the slide sleeves 37, 38 are magnified to be transmitted to the actuation pieces 59, 60, respectively.

Position adjusting mechanisms for the actuation sleeves 45, 46 will hereinafter be described with reference to FIGS. 4 and 5. The main body 31 aadjusting screw shafts 63, 64 are extended and with which their screw portions 65, 66 are threadedly engaged, respectively. These screw shafts 63, 64 are provided at each one end thereof with keys 67 and 68, which are slidable within keyways formed on the internal surfaces of the actuation sleeves 45 and 46, so that the screw shafts 63, 64 are movable bodily with the actuation sleeves 45, 46 only during rotation, respectively. Furthermore, adjusting knobs 69, 70 are secured to the other end of each of the screw shafts 63, 64, respectively.

Accordingly, the manual rotation of the adjusting knob 69 causes the position of the actuation sleeve 45, that is, of the contact roller 51 to change relative to the slide sleeve 37, thus making it possible to change or adjust the rotational angle $\theta$ of the movable wing 25 of the rotational actuator 14 which defines a total grinding feed stroke of the wheel head 11. On the other hand, the manual rotation of the adjusting knob 70 causes the position of the actuation sleeve 46, that is, of the contact roller 52 to change relative to the slide sleeve 38, thus making it possible to change or adjust a fine grinding feed stroke of the total grinding feed stroke.

Figure 6:
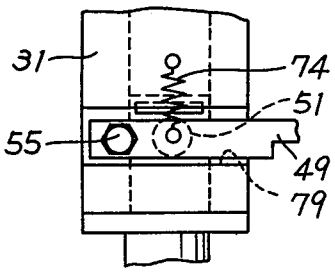
FIG. 6 is a fragmental view of the setting device as looking in a direction indicated by the arrow VI of FIG. 3.

The adjusting knobs 69 and 70 are formed at their outer surfaces with graduations 71 and 72, respectively, from which an operator is able to know adjusted total and fine grinding feed strokes of the wheel head 11. Interposed between the cradle yoke 32 and the support sleeve 61 is a tension spring 73, which urges the follower roller 34 to come into contact with the circumferential cam way of the plate cam 30. Between the lever arm 49 and the main body 31 and between the lever arm 50 and the guide bush 31a, there are interposed tension springs 74 and 75, which urge the contact rollers 51, 52 to come into contact with the flanges 47, 48 of the actuation sleeves 45, 46, respectively. A compression spring 76 is also interposed between the guide bush 31a and the slide sleeve 38 so as to make the flange 40 contact the guide roller 36. Indicated at 79 and 80 are stop faces, which as typically shown in FIG. 6, are formed on the main body 31 and the guide bush 31a to thereby prevent the pivotal overmotions of the lever arms 49 and 50 which might cause the failures of the limit switches 57 and 58, respectively.

The operation of the apparatus aas constructed above will hereinafter be described. All the FIGURES show an original condition of the apparatus, wherein the limit switch 57 is kept actuated. In the beginning, the wheel head 11 is rapidly advanced by the rapid feed cylinder 17, whereafter change-over valves 90 and 91 (FIG. 2) are switched to deliver pressurized fluid into the rotational actuator 14, thereby rotating the cylinder housing 22 in a direction indicated by the arrow ARW. Exhaust fluid from the rotational actuator 14 is discharged mainly through a first throttle valve 93. This causes the feed screw 12 to be rotated through the clutch 16, the hand wheel 15 and the drive shaft 13, whereby the wheel head 11 is advanced at a rough grinding feed rate set by the throttle valve 93.

The rotation of the cylinder housing 22 causes the plate cam 30 to rotate in the same direction as the cylinder housing 22, and the cradle yoke 32, which follows the circumferential cam way of the plate cam 30, is pivoted about the hinge shaft 33 in a counterclockwise direction as viewed in FIG. 4, against the force of the spring 73. Consequently, the slide sleeves 37 and 38 are slidden, together with the actuation sleeves 45 and 46 threadedly engaged therewith, in an upward direction as viewed in FIG. 4. The lever arms 49 and 50, which are urged to come into contact with the actuation sleeves 45, 46 through the contact rollers 51, 52 are thus pivoted about the hinge pins 55 and 56, respectively, and the limit switch 57 is first released from actuation by the actuation piece 59 of the lever arm 49.

The rough grinding feed by the rotational actuator 14 of the wheel head 11 is thereafter continued, simultaneously with which the pivotal movements of the lever arms 49, 50 are further effected through the cradle yoke 32, the slide sleeves 37, 38, the actuation sleeves 45, 46 and the contact rollers 51, 52. When the limit switch 58 is actuated by the actuation piece 60 of the lever arm 50, a change-over valve 92 shown in FIG. 2 is switched in response to a signal supplied from the limit switch 58. This causes the exhaust fluid from the rotational actuator 14 to be discharged only through a second throttle valve 94, whereby the feed rate of the wheel head 11 is changed to a fine grinding feed rate set by the second throttle valve 94. Further, when the wheel head 11 is subsequently advanced through a preselected fine feed amount, the movable wing 25 of the rotational actuator 14 is brought into abutting engagement with the dead stop 24 with the result of discontinuing the feed movement of the wheel head 11, and this is confirmed by the limit switch 27 since the same is actuated at this time by the dog 26 provided on the cylinder housing 22 as shown in FIG. 2.

When the grinding feed of the wheel head 11 is completed in the foregoing manner, the rapid retraction feed of the wheel head 11 is effected by the rapid feed cylinder 17 immediately or after the expiration of a predetermined short period of time, during which the change-over valve 91 is kept blocked as shown in FIG. 2 for spark-out grinding. Simultaneously with the reverse operation of the rapid feed cylinder 17, the change-over valves 90 and 92 are restored to their positions as shown in FIG. 2, and where the spark-out grinding is carried out, the change-over valve 91 is also switched as the result of a solenoid thereof being energized. Pressurized fluid is therefore admitted through a check valve 95 into the rotational actuator 14 to reversely rotate the cylinder housing 22. The reverse rotation of the cylinder housing 22 results in the reverse rotation of the plate cam 30, and the cradle yoke 32 is pivoted in a clockwise direction as viewed in FIG. 4 as it follows the plate cam 30. The pivotal movement of the cradle yoke 32 is transmitted to the lever arms 49, 50, respectively, through the slide sleeves 37, 38, the actuation sleeves 45, 46 and the contact rollers 51, 52, and this results in actuating the limit switch 57 when the plate cam 30 is reversely rotated through a preselected angular distance $\theta$ shown in FIG. 2. It is to be noted herein that the angular distance $\theta$ through which the cylinder housing 22 rotates defines a total grinding feed amount of the wheel head 11 and is adjustable as desired by manipulating the knob 69. The limit switch 57, when so actuated, causes the change-over valve 91 to be switched so as to thereby discontinue the admittance and exhaust of fluid into and from the rotational actuator 14, and one cycle of the grinding operation is thus completed with the movable wing 25 being positioned as shown in FIG. 2.

Although the feed amount setting device in the above-noted embodiment includes two setting mechanisms one for the total grinding feed and the other for the fine grinding feed, it is however to be noted that in the case where the setting of one of the total and fine grinding feed amounts is unnecessary or is otherwise achieved by the use of any other means than as described herein, the feed amount setting device may be constructed by any one of the setting mechanisms shown in FIGS. 4 and 5 and that in this case, such any one of the mechanisms may be used for setting either of the total and fine grinding feed amounts.

Obviously, numerous modifications and variations of the present invention are possible in light of the above teachings. It is therefore to be understood that within the scope of the appended claims, the invention may be precticed otherwise than as specifically described herein.

What is claimed as new and desired to be secured by the Letters Patent of the United States is:

1. A feed amount setting device for a machine tool wherein a feed device is provided to relatively feed tool and workpiece carriers, comprising:

a cam member supported to be movable by said feed device and having a cam way;

a cradle member supported for pivot movement within a first plane perpendicular to a second plane including said cam way and urged to contact said cam way;

a slide sleeve supported for axial sliding movement in a direction parallel to said first plane and formed with a contact surface which extends perpendicularly to the axis of said slide sleeve for contact engagement with said cradle member;

an actuation sleeve coaxially received in and threadedly engaged with said slide sleeve, said actuation sleeve being formed with an actuation surface extending in parallel relation with said contact surface;

adjusting means for rotating said actuation sleeve to thereby displace the same relative to said slide sleeve in the axial direction thereof;

a lever arm pivotably carried and urged to contact said actuation surface of said actuation sleeve for transmitting the axial movement of said actuation sleeve to one end thereof in a predetermined magnification ratio; and a switch element stationarily disposed in abuttable relation with said one end of said lever arm for controlling said feed device when actuated by said one end of said lever arm.

2. A feed amount setting device as set forth in claim 1, wherein:

said cam member is rotatable by said feed device and formed with said cam way at a circumferential surface thereof;

said slide sleeve is slidable in a direction parallel to the rotational axis of said cam member; and said cradle member takes the form of an L-letter for contacting said cam way of said cam member and said contact surface of said slide sleeve respectively at both ends thereof.

3. A feed amount setting device as set forth in claim 2, further comprising:

a first roller carried at one end of said cradle member for rotation about an axis extending perpendicularly to the pivot axis of said cradle member and urged to contact said cam way of said cam member; and a second roller carried at the other end of said cradle member for rotation about an axis extending in parallel relation with the pivot axis of said cradle member and urged to contact said contact surface of said slide sleeve.

4. A feed amount setting device as set forth in any one of claims 1 to 3, wherein said adjusting means comprises:

a manipulation shaft rotatably carried and inserted at one end thereof into the actuation sleeve; and key means held on said one end of said manipulation shaft and snugly received within keyway means formed on an internal surface of said actuation sleeve.

* * * * *